US012741353B2

(12) United States Patent
Stone et al.

(10) Patent No.: US 12,741,353 B2
(45) Date of Patent: Sep. 22, 2026

(54) COATING REMOVAL APPARATUS AND METHOD

(71) Applicant: Yield Engineering Systems, Inc., Fremont, CA (US)

(72) Inventors: Alan Lee Stone, Bloomingale, IL (US); Kevin Bruce McGillivray, Agua Dulce, CA (US); Christopher Lane, Los Gatos, CA (US)

(73) Assignee: Yield Engineering Systems, Inc., Fremont, CA (US)

( * ) Notice: Subject to any disclaimer, the term of this patent is extended or adjusted under 35 U.S.C. 154(b) by 676 days.

(21) Appl. No.: 18/075,997

(22) Filed: Dec. 6, 2022

(65) Prior Publication Data

US 2024/0181590 A1 Jun. 6, 2024

(51) Int. Cl.

| | |
|---|---|
| ***B24B 7/10*** | (2006.01) |
| ***B24B 7/08*** | (2006.01) |
| ***B24B 29/00*** | (2006.01) |
| ***B24B 41/00*** | (2006.01) |
| ***B24B 55/02*** | (2006.01) |
| ***B24B 57/02*** | (2006.01) |

(52) U.S. Cl.

CPC ..... *B24B 7/10* (2013.01); *B24B 7/08* (2013.01); *B24B 29/005* (2013.01); *B24B 41/002* (2013.01); *B24B 55/02* (2013.01); *B24B 57/02* (2013.01)

(58) Field of Classification Search

CPC ..... B24B 7/10; B24B 7/08; B24B 29/005; B24B 55/02; B24B 57/02; B24B 27/0076; B08B 1/36

USPC ..... 451/57, 262; 15/77, 102

See application file for complete search history.

(56) References Cited

U.S. PATENT DOCUMENTS

| | | | | |
|---|---|---|---|---|
| 5,378,281 | A * | 1/1995 | Kamata | B05D 1/28 118/212 |
| 5,590,672 | A * | 1/1997 | Ohmori | B08B 3/04 211/41.18 |
| 5,624,501 | A * | 4/1997 | Gill, Jr. | H10P 72/0414 134/32 |
| 6,678,911 | B2 * | 1/2004 | Krupa | H01L 21/67046 15/88.2 |
| 7,516,507 | B1 * | 4/2009 | Oxsen | B08B 3/12 15/21.1 |
| 2011/0195279 | A1 * | 8/2011 | Saeki | B08B 1/34 428/64.2 |
| 2021/0039986 | A1 * | 2/2021 | Agnello | C03C 3/087 |
| 2022/0270889 | A1 * | 8/2022 | Benvegnu | H01L 21/67751 |

* cited by examiner

*Primary Examiner* — Makena S Markman

(74) *Attorney, Agent, or Firm* — Fish & Richardson P.C.

(57) ABSTRACT

A coating removal apparatus includes multiple pairs of rotatable brushes spaced apart from each other in a first direction. Each pair of brushes may include two opposing brushes that are configured to rotate about a common axis and move towards and away from each other in a second direction transverse to the first direction. When a coated panel is positioned between the two opposing brushes, first portions of the brushes may separably engage with and rotate on opposite surfaces of the coated panel. The apparatus may also include one or more liquid tanks configured to contain a liquid. When the tanks contain the liquid and when the coated panel is positioned between the two opposing brushes, second portions of the two brushes may at least contact the liquid in the liquid tanks.

18 Claims, 5 Drawing Sheets

COATING REMOVAL APPARATUS AND METHOD

TECHNICAL FIELD

The present disclosure relates to an apparatus and a method for the removal of one or more coatings on a panel.

BACKGROUND

Currently there are limited ways to remove coatings (e.g., Ajinomoto Build-up Film (ABF) coatings, copper coatings, etc.) from panels (e.g., glass panels, silicon panels, substrates, etc.) in the semiconductor industry. Traditionally, two main methods are used for removing coatings from panels. One method uses laser ablation where a suitable laser beam (e.g., a YAG laser) is focused on the coated panel to ablate the coating. In addition to requiring multiple passes for satisfactory coating removal, such a removal method may also result in a substantial amount of debris requiring subsequent cleaning steps. Furthermore, lasers are expensive and may require good ventilation and other protection systems for safe use. With panels becoming thinner (e.g., 200-250 micron), traditional laser coating removal methods risk breaking fragile panels. Additionally, some coatings (such as, for example, copper, titanium, etc.) are difficult to remove using a laser because of the large amount of energy needed for their removal.

Another traditional coating removal method involves directing a focused fluid stream on a coated panel through a nozzle. There are several problems associated with such a coating removal method. For example, some solvent based sprays are flammable and may pose safety concerns. Collection of solvent vapor and waste fluid may also be challenging. In some cases, the time required for coating removal may be long and the fluid cost high.

The apparatus and methods of the current disclosure may alleviate at least some of the above-described deficiencies. However, the scope of the current disclosure is defined by the claims and not by its ability to solve any problem.

SUMMARY

Several embodiments of an apparatus for coating removal and method of coating removal are disclosed.

In one embodiment, an apparatus to remove a coating from a coated panel is disclosed. The apparatus may include multiple pairs of rotatable brushes spaced apart from each other in a first direction. Each pair of rotatable brushes may include two opposing brushes with end faces that face each other. And the two opposing brushes of each pair of rotatable brushes may be configured to rotate about a common axis, and move towards and away from each other in a second direction transverse to the first direction. When a coated panel is positioned between the end faces of the two opposing brushes, first portions of the two opposing brushes may separably engage with and rotate on opposite surfaces of the coated panel. The apparatus may also include one or more liquid tanks configured to contain a liquid. When the one or more liquid tanks contain the liquid and when the coated panel is positioned between the end faces of the two opposing brushes, second portions of the two opposing brushes may at least contact the liquid in the one or more liquid tanks.

In another embodiment, an apparatus to remove a coating from a coated panel is disclosed. The apparatus may include multiple pairs of rotatable brushes spaced apart from each other in a first direction. Each pair of rotatable brushes may include two opposing brushes with end faces that face each other and may be configured to rotate about a common axis that extends in a second direction transverse to the first direction, and move towards and away from each other in the second direction. When a coated panel is positioned between the end faces of the two opposing brushes, top portions of the two opposing brushes may separably engage with and rotate on opposite surfaces of the coated panel. The apparatus may also include multiple liquid tanks. Each liquid tank may be configured to contain a liquid and may be configured to be positioned below a different pair of rotatable brushes of the multiple pairs of rotatable brushes such that when the coated panel is positioned between the two opposing brushes of the pair of rotatable brushes, top portions of the two opposing brushes engage with and rotate on opposite surfaces of the coated panel and bottom portions of the two opposing brushes engage with the liquid in the liquid tank. The apparatus may also include a pair of fluid cooled cold plates spaced apart from each in the second direction to define a gap therebetween. When the coated panel is positioned between the two opposing brushes, the coated panel may extend through the gap between the pair of fluid cooled cold plates.

BRIEF DESCRIPTION OF THE DRAWINGS

The accompanying drawings, which are incorporated herein and constitute a part of this disclosure, illustrate exemplary embodiments and, together with the description, are used to explain the disclosed principles. In these drawings, where appropriate, reference numerals that illustrate the same or similar structures, components, materials, and/or elements in different figures are labeled similarly. It is understood that various combinations of the structures, components, and/or elements, other than those specifically shown, are contemplated and are within the scope of the present disclosure.

For simplicity and clarity of illustration, the figures depict the general structure of the various described embodiments. Details of well-known components or features may be omitted to avoid obscuring other features, since these omitted features are well-known to those of ordinary skill in the art. Further, features in the figures are not necessarily drawn to scale. The dimensions of some features may be exaggerated relative to other features to improve understanding of the exemplary embodiments. One skilled in the art would appreciate that the features in the figures are not necessarily drawn to scale and, unless indicated otherwise, should not be viewed as representing dimensions or proportional relationships between different features in a figure. Additionally, even if it is not expressly mentioned, aspects described with reference to one embodiment or figure may also be applicable to, and may be used with, other embodiments or figures.

DETAILED DESCRIPTION

Figure 1A:
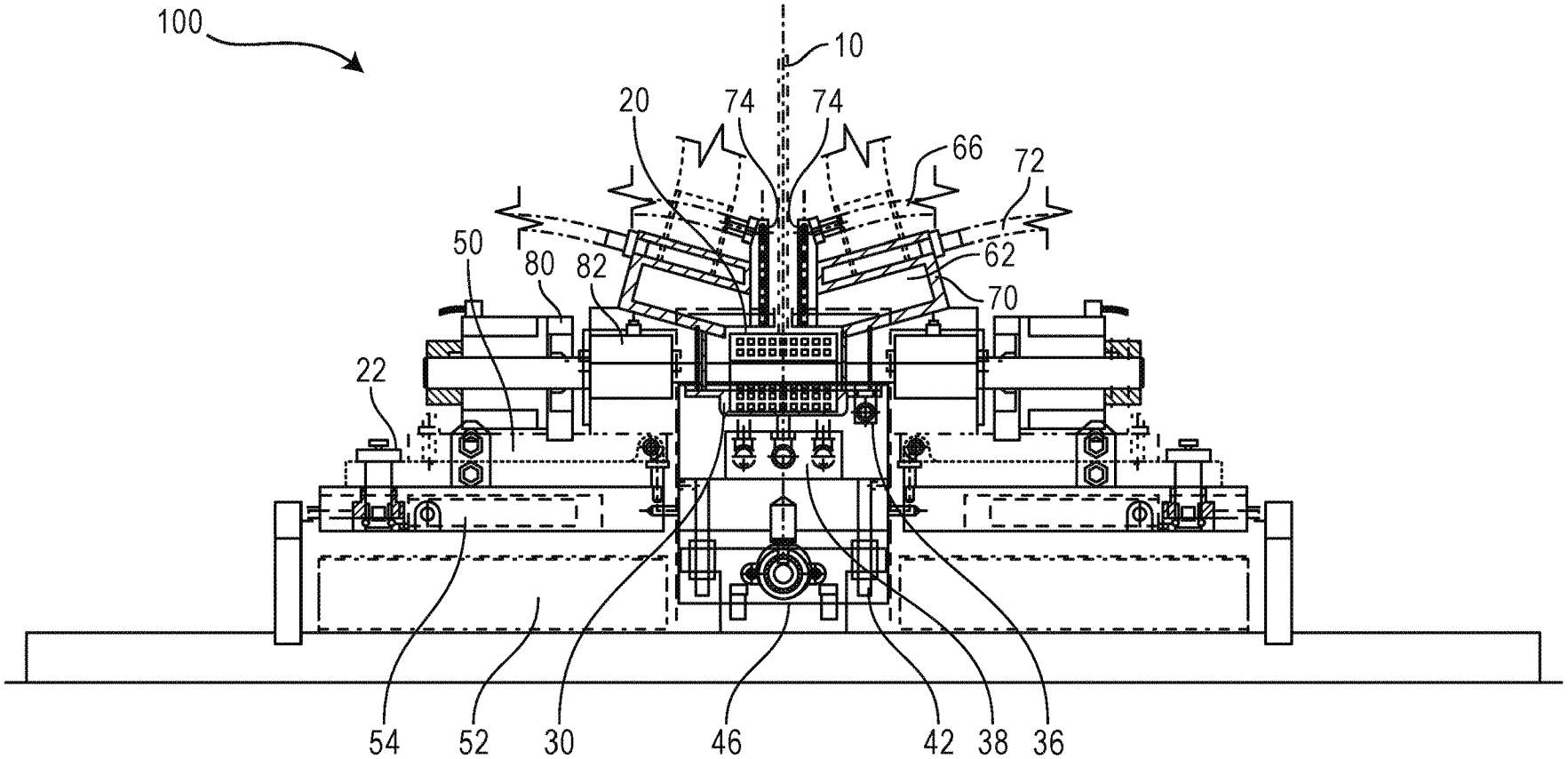
FIGS. 1A and 1B illustrate side views of an exemplary apparatus used to remove coatings from a panel.

All relative terms such as "about," "substantially," "approximately," etc., indicate a possible variation of +10% (unless noted otherwise or another degree of variation is specified). For example, a feature (e.g., slot, etc.) disclosed as being about "t" units wide (or length, thickness, depth, etc.) may vary in width from (t–0.1 t) to (t+0.1 t) units. In some cases, the specification also provides context to some of the relative terms used. For example, a structure (e.g., groove) described as being substantially semicircular or rectangular in cross-sectional shape may deviate (e.g., 10% deviation, etc.) from being perfectly semicircular or rectangular. Further, a range described as varying from, or between, 5 to 10 (5-10), includes the endpoints (i.e., 5 and 10).

Unless otherwise defined, all terms of art, notations, and other scientific terms or terminology used herein have the same meaning as commonly understood by persons of ordinary skill in the art to which this disclosure belongs. Some components, structures, and/or processes described or referenced herein are well understood and commonly employed using conventional methodology by those skilled in the art. These components, structures, and processes will not be described in detail. All patents, applications, published applications and other publications referred to herein as being incorporated by reference are incorporated by reference in their entirety. If a definition or description set forth in this disclosure is contrary to, or otherwise inconsistent with, a definition and/or description in these references, the definition and/or description set forth in this disclosure controls over those in references incorporated by reference. None of the references described or referenced herein is admitted as prior art relative to the current disclosure.

The discussion below describes an exemplary apparatus and method used to remove a coating from an edge (or the edge zone) of a panel. It should be noted that the specific features of the described apparatus are not limitations. Instead, embodiments of the described apparatus may be used to remove any coating(s) from any substrate in any suitable application. For example, the disclosed apparatus and method may be used to remove any type of one or more coatings (organic, inorganic, metallic, etc.) from any type of substrate (e.g., panel, wafer, base plate, etc.). In the discussion below, the term "panel" is used broadly to refer to any component having a relatively flat surface upon which a coating is disposed (conformally, as patches, in regions, etc.). For example, as used herein, a panel includes a plate, a semiconductor wafer, a wafer with multiple IC devices formed thereon, a single IC device, a substrate (e.g., ceramic, organic, metallic, etc.) with one or more coatings formed or disposed thereon, etc. The "coating" on the panel may be formed of any material (organic, inorganic, metallic, etc.), have any thickness, and may, without limitation, be disposed on the panel by any known method (e.g., deposited, sprayed, plated, grown on, etc.).

Figure 1B:
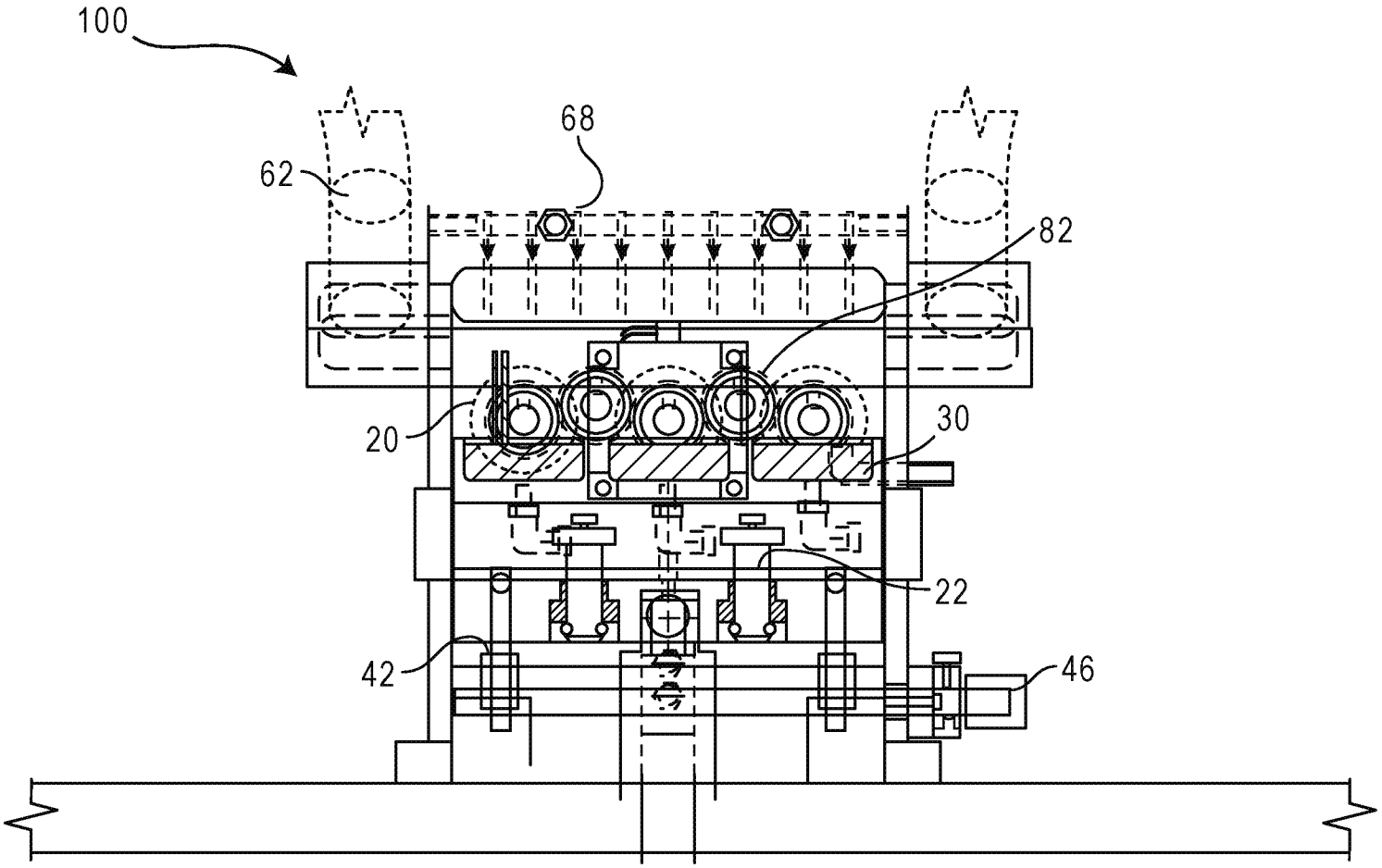
Figure 2A:
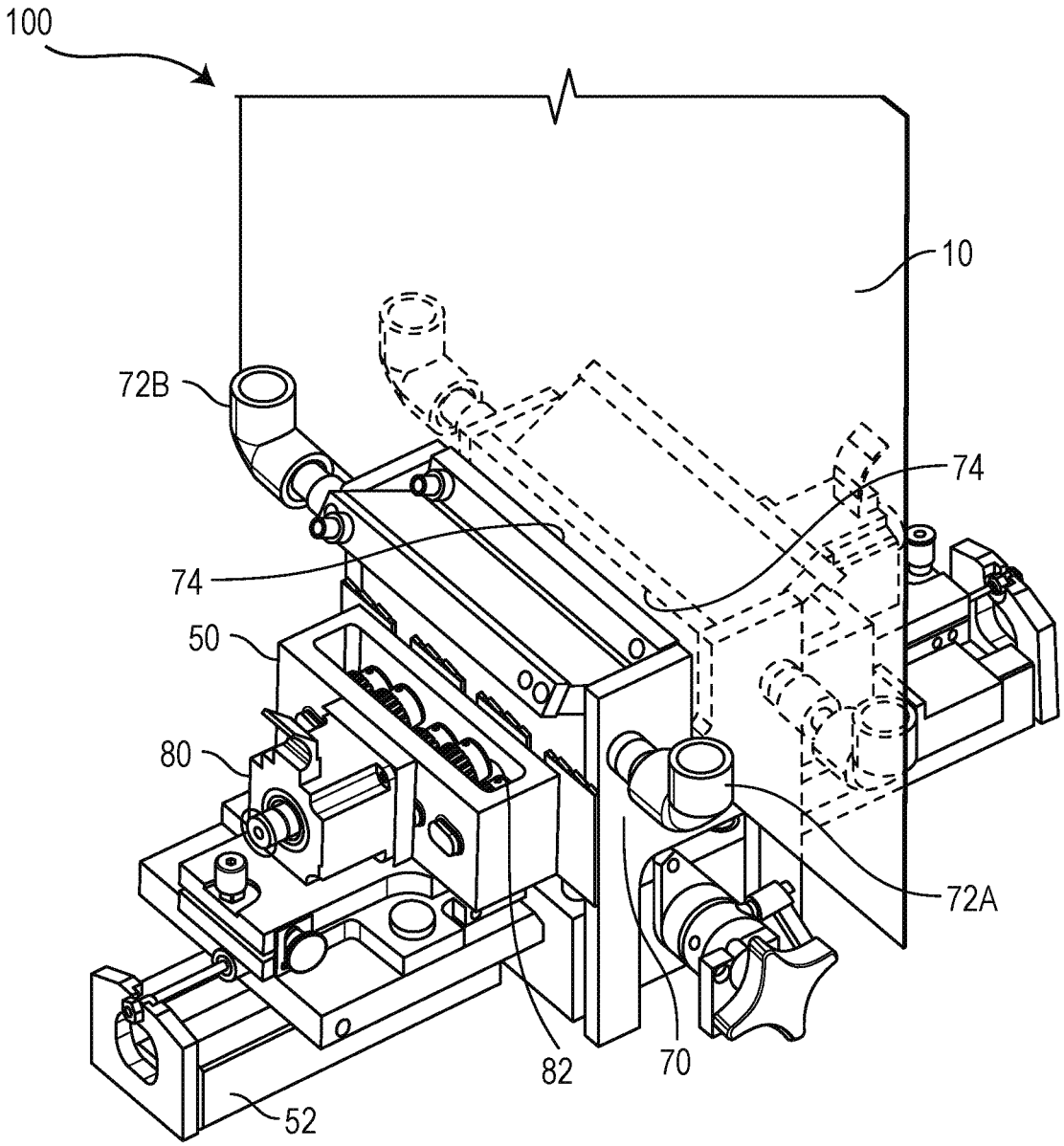
FIGS. 2A and 2B illustrate exemplary perspective views of portions of the apparatus of FIG. 1A.
Figure 2B:
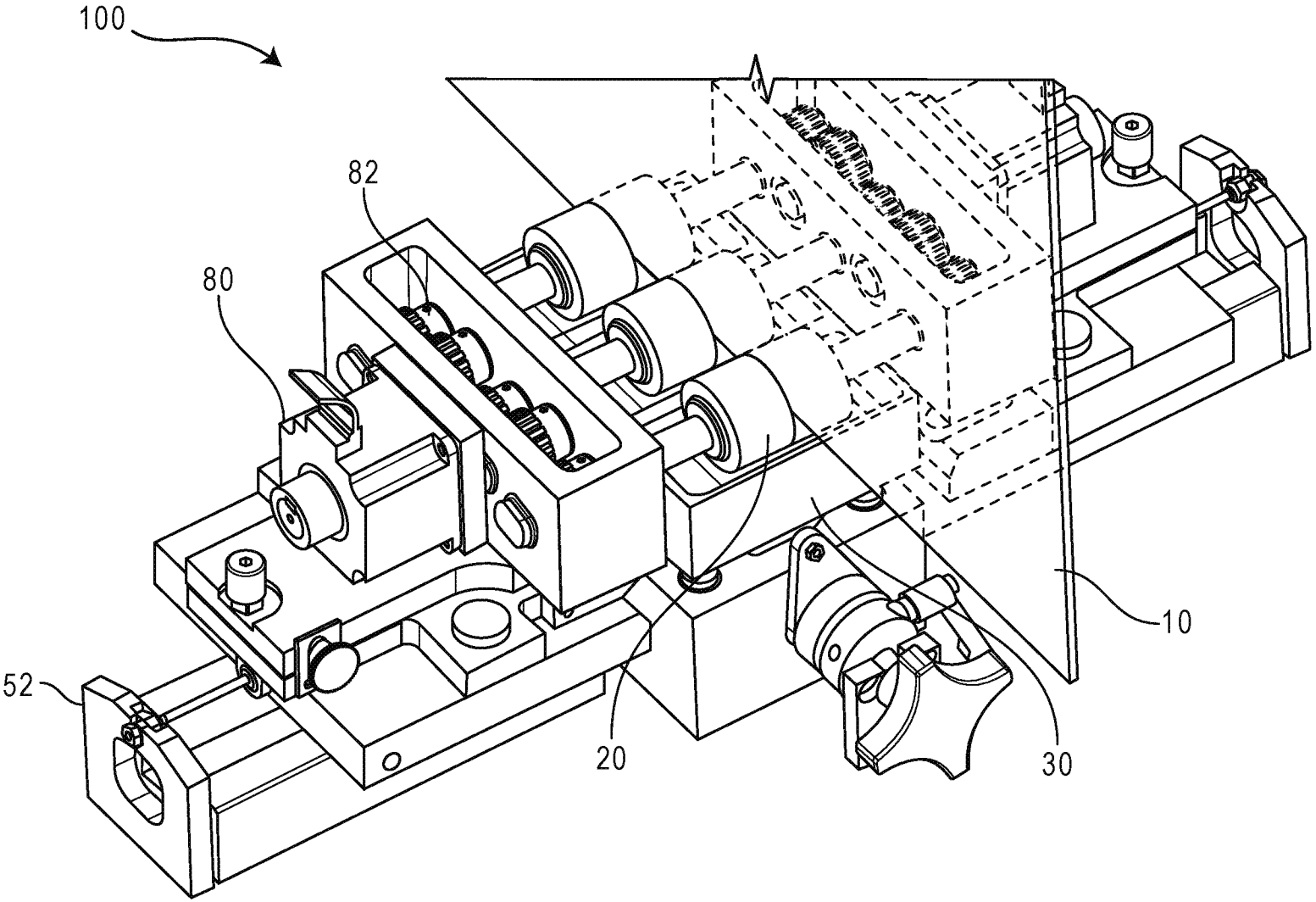
Figure 3B:
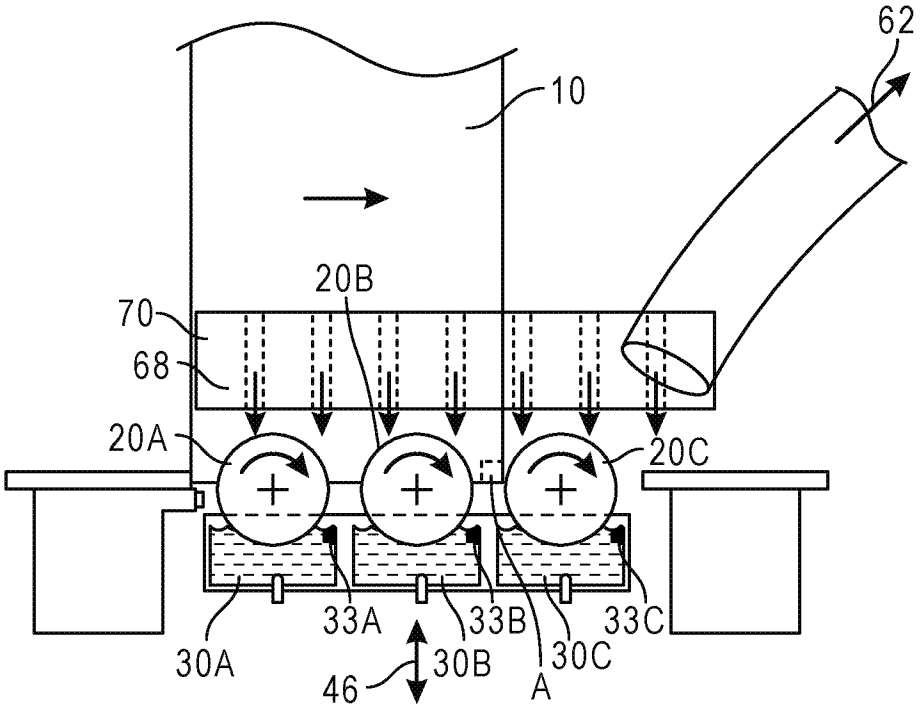
FIGS. 3A and 3B are schematic illustrations of exemplary aspects of the apparatus of FIG. 1.
Figure 3A:
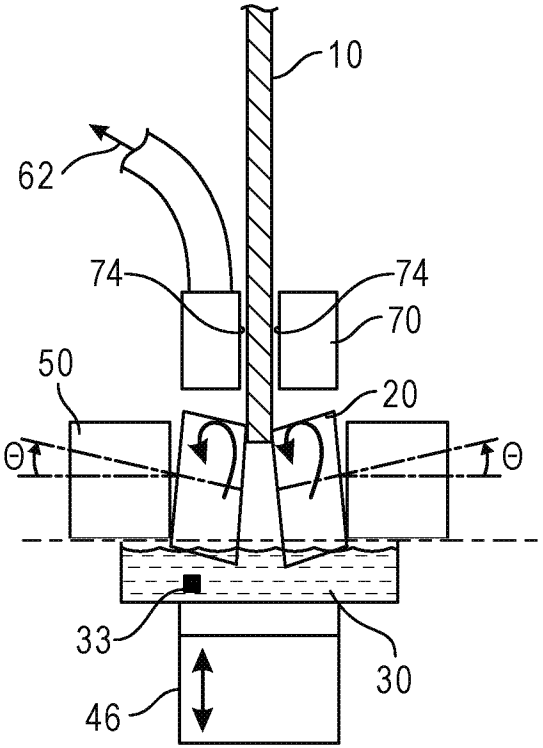

FIGS. 1A and 1B illustrate side views of an exemplary apparatus 100 of the current disclosure that may be used to remove the coating from the edge zone of panel 10. FIGS. 2A and 2B illustrate perspective views of the apparatus with some components removed to show details and features covered by these components. FIGS. 3A and 3B are schematic illustrations of the apparatus to highlight some relevant aspects of the apparatus. In the discussion below, reference will be made to all figures (i.e., FIGS. 1A-3B).

As best seen in FIGS. 2B-3B, apparatus 100 includes one or more pairs of rotatable brushes 20 configured to press on and rotate against opposite sides at one end (e.g., the bottom edge) of a coated panel 10. Although three pairs of brushes 20 are illustrated in these figures (see, e.g., FIG. 2B), this is only exemplary. In some embodiments, apparatus 100 may only include one pair of brushes 20, while in other embodiments apparatus 100 may include two or more pairs (e.g., 2, 3, 4, 5, 6, 7, 8, 9, 10 pairs, etc.) of brushes 20. Although not a requirement, in some embodiments, all brushes 20 may rotate in the same direction. The rotation of the brushes 20 in the same direction may assist the translation of the panel 10 between the pairs of brushes 20 (see, e.g., FIG. 3B). It is also contemplated that, in some embodiments, all brushes 20 on one side of panel 10 may rotate in one direction and all the brushes 20 on the opposite side of the panel 10 may rotate in the opposite direction. The brushes 20 may be mounted on opposed friction free (or frictionless) air slides 52. Air slides 52 along with associated air cylinders 54 may be configured to move the brushes 20 on opposite sides of panel 10 towards and away from panel 10. During operation, the opposing rotating brushes 20 may engage with (e.g., press against) and apply a relatively constant force (e.g., compressive force) on panel 10. In some embodiments, all brushes 20 may be geared together and may be driven by a single motor. In some embodiments, as best seen in FIGS. 2A and 2B, a gear drive 82 may couple brushes 20 on each side of the panel 10 to separate drive motors 80. During operation of apparatus 100, panel 10 passes substantially vertically between the flat end faces of opposing pairs of brushes 20 (see FIGS. 2B and 3A). During a batch process, multiple panels 10 may pass one after another between brushes 20. A tilt mechanism 50 may provide angular adjustments to the brushes so that the mating end faces of brushes 20 remains flush with the surfaces of panel 10, for example, if panel 10 is not sufficiently vertical, if any deflection occurs in panel 10 or other components of apparatus 100, etc. In some embodiments, as illustrated in FIG. 3A, the brushes 20 may be tilted (by an angle θ) with respect to the horizontal axis. Tilting the brushes 20 in this manner aids in creating a sharper line at the top to the coating removal zone. Tilting the brushes 20 may also aid in minimizing any deflection that the brushes 20 might experience since, typically, a brush is stiffer at the hub than at its outer diameter. The magnitude of angle θ may depend on the type of brush used (e.g., material, size, etc.). In general, angle θ may be between about 0-10°, or preferably between 2-5°. Although the type of brushes 20 may depend on the application (e.g., type of coating, type of panel, etc.), in some embodiments (e.g., when the panel is glass and the coating is ABF), brushes 20 may be made of a polyolefin foam. However, other types of brushes may be used.

Brushes 20 may be rotatably coupled to apparatus 100 using any suitable mechanism. In some embodiments, brushes 20 may be removably and rotatably coupled to apparatus 100. In some embodiments, brushes 20 may be detachably mounted on a drive shaft with quick-release pins 22. Low friction air cylinders 54 coupled to the drive shaft may move brushes 20 towards and away from panel 10 to engage with and disengage (e.g., contact and retract) from panel 10. Air cylinders 54 may be adapted to press the opposing brushes 20 against panel 10 with sufficient force to aid in the removal of the coating from panel 10. In some embodiments, air cylinders 54 may be configured to provide a variable force to brushes 20, and apparatus 100 may include a control mechanism with a feedback loop that adjusts air cylinders 54 to vary the force on brushes 20 based on, for example, a measured result indicative of the amount of coating removed. For example, with reference to FIG. 3B, in an exemplary application, sensors (e.g., optical sensors, etc.) downstream of brushes 20 may detect the presence/absence of (or the amount of) residual coating on panel 10, and based (at least partly) on this detected result, a feedback loop may vary processing parameters including the compressive force of brushes 20 on panel 10. In some embodiments, hollow-shaft stepper motors 80 may be used to rotate brushes 20. The hollow shaft may allow the assembly to be designed in a short configuration thus saving space.

As best seen in FIGS. 3A and 3B, during operation of apparatus 100, a region at the top end of each brush 20 contacts a surface at the bottom edge (e.g., bottom edge zone) of the panel 10 and a region at the bottom end of the brush 20 is disposed in a liquid tank 30. When brushes 20 rotate and rub against panel 10, some of the coating (on panel 10) may separate from the surface of panel 10 and get deposited on the liquid in liquid tank 30. Additionally and/or alternatively, in some embodiments, as a brush 20 passes through liquid tank 30, the brush carries (collects, absorbs, retains, etc.) and deposits (distributes, smears, etc.) some of the liquid on panel 10 (e.g., as it rubs against panel 10) to dissolve (or otherwise separate) and remove some of the coating from panel 10. The coating may be removed from panel 10 by the interaction of brushes 20 and the liquid (from liquid tank 30) by any mechanism (mechanical, chemical, etc.). Regardless of the removal mechanism, as brushes 20 rotate, they transfer portions of the coating from panel 10 to the liquid in liquid tank 30. As the interaction of brushes 20 on panel 10 continues, more and more of the coating from panel 10 may be transferred to the liquid in liquid tank 30. In general, during operation of apparatus 100, when the top end of each brush 20 engages with a surface of the panel 10, the bottom end of the brush 20 engages with the liquid in a liquid tank 30. In some embodiments, the bottom end of each brush 20 may be submerged in the liquid in liquid tank 30, while in other embodiments, the bottom end of each brush 20 may only contact (e.g., skim) the liquid in liquid tank 30. Liquid tanks 30 may include (or contain) any liquid (e.g., water, a chemical, etc.) suitable for an application. The type of liquid may depend on the application (e.g., the coating to be removed). In some embodiments (e.g., when the coating is ABF), liquid tanks 30 may include a solvent, such as, for example, acetone, IPA, or other formulations of chemicals. In general, the liquid used may include any liquid, solvent, acid, or chemical suitable for the coating(s) to be removed.

In some embodiments, all brushes 20 may be associated with a single liquid tank 30. In other words, in such embodiments, all brushes 20 may engage with the liquid contained in a single liquid tank 30. In some embodiments, each brush 20 may be associated with a different liquid tank 30. In some embodiments, as illustrated in FIGS. 3A and 3B, each pair of opposing brushes 20 may be associated with a separate liquid tank 30. For example, as shown in FIG. 3B, a first pair of opposing brushes 20A may contact and rotate through the liquid in a first liquid tank 30A, a second pair of opposing brushes 20B may contact and rotate through the liquid in a second liquid tank 30B, and a third pair of opposing brushes 20C may contact and rotate through the liquid in a third liquid tank 30C. In such embodiments, the bottom ends of the two brushes 20 of each pair of opposing brushes 20 rotates through the same liquid tank. With reference to FIG. 3B, when panel 10 moves between the multiple pairs of brushes 20, a same region (e.g., region A of FIG. 3B) at the bottom edge of panel 10 first engages with (or is rubbed between) the first pair of opposing brushes 20A, then engages with the second pair of opposing brushes 20B, and finally engages with the third pair of opposing brushes 20C. As panel 10 travels downstream through brushes 20, region A gets progressively stripped of the coating and the liquid in the downstream liquid tanks 30 remain progressively cleaner. Thus, the liquid tanks downstream (with reference to the direction of panel travel) may have cleaner liquid than the liquid tanks upstream. For example, in FIG. 3B, the first liquid tank 30A may have clean liquid, the second liquid tank 30B may have cleaner liquid, and the third liquid tank may have the cleanest liquid. Although not a requirement, the inventors believe that this method of varying cleanliness of the liquid in the liquid tanks may assist in achieving a debris-free finished panel.

In some embodiments, all the brushes 20 of apparatus 100 may be made of the same material (e.g., polyolefin foam, etc.). However, this is not a requirement, and in some embodiments, different pairs of brushes 20 may be made of different materials having different properties. For example, with reference to FIG. 3B, in some embodiments, the first pair of opposing brushes 20A may be made of a first material, the second pair of opposing brushes 20B may be made of a second material, and the third pair of opposing brushes 20C may be made of a third material. The first, second, and third materials may be selected to optimize coating removal from panel 10 with minimal degradation or impact to the surface of panel 10. For example, in some embodiments, the material used to form the second pair of brushes 20B (i.e., second material) may be coarser than the material used to form the third pair of brushes 20C and softer than the material used to form the first pair of brushes 20A (or vice versa). It is also contemplated that some of the pairs of brushes (20A, 20B, 20C) may be made of the same material while other pairs of brushes may be made of a different material. For example, in some embodiments, the first and second pair of brushes 20A, 20B may be made of the same material and the third pair of brushes 20C may be made of a softer or a coarser material. In some embodiments, the first pair of brushes 20A may be made of one material and the second and third pair of brushes 20B and 20C may be made of a different (coarser or softer) material.

In the embodiment of apparatus 100 illustrated in FIG. 1A, each pair of brushes 20 (e.g., 20A, 20B, 20C of FIG. 3B) of apparatus 100 may apply relatively the same amount of pressure or compressive force on panel 10 positioned between them. In other words, each pair of brushes 20 may press against the panel with a similar force. However, this is not a requirement, and in some embodiments, different pairs of brushes 20 may apply a different amount of compressive force on panel 10 to optimize the coating removal process. For example, with reference to FIG. 3B, in some embodiments, the first pair of opposing brushes 20A may apply a first compressive force ($F_1$) on panel 10, the second pair of opposing brushes 20B may apply a second compressive force ($F_2$) on panel 10, and the third pair of opposing brushes 20C may apply a third compressive force ($F_3$) on panel 10. The magnitudes of the first, second, and third compressive forces may be selected to optimize coating removal from panel 10 with minimal degradation or impact to the surface of panel 10. For example, in some embodiments, the magnitudes of the first compressive force may be greater than (or equal to) the magnitude of the second compressive force and the magnitude of the second compressive force may be greater than (or equal to) the magnitude of the third compressive force (or vice versa). In some embodiments, each pair of brushes 20 may apply a constant force (over time) on panel 10. In other words, with reference to FIG. 3B, the first pair of brushes 20A (for example) may apply substantially the same compressive force $F_1$ to region A for the entire time region A is positioned between these brushes. However, this is not a requirement, and in some embodiments, the magnitude of the compressive force ($F_1$, $F_2$, $F_3$) applied by the pair of brushes (20A, 20B, 20C) on the panel may steadily increase or decrease with time.

In some embodiments, the liquid (e.g., chemical solvent) used in liquid tanks 20 may release fumes (e.g., hazardous fumes) during operation of apparatus 100. Apparatus 100 includes features that assist in fume mitigation and management. A region near the location where brushes 20 contact panel 10 (i.e., the brush-contact region) may be connected to a vacuum chamber 62 linked to an outside exhaust to extract solvent or chemical fumes from this region. A region above the brush-contact region may include a pair of spaced-apart cold plates 70 to cool the released fumes and cause it settle into liquid tanks 30. As best seen in FIGS. 2A and 3A, a pair of cold plates 70 (each with a chilled coolant supply 72) may be spaced apart from each other to form a gap therebetween and disposed directly above brushes 20. Panel 10 passes through the gap between the pair of cold plates 70 to enter the space between the pairs of opposing brushes 20. Since panel 10 moves (see FIG. 3B) through the gap between the cold plates 70, the thickness of the gap between the cold plates 70 may be greater than the thickness of panel 10. Cold plate 70 may include a relatively large cooling surface 74 that faces each other and defines the gap that panel 10 passes through and a fluid inlet 72A and fluid outlet 72B to pass a chilled coolant therethrough. These opposing cooling surfaces 74 cool the vertical space above the brushes 20 to decrease the likelihood of fumes from escaping upwards. Any condensate from this cooling surface 74 runs downward to a collection trough which returns the fluid back to a liquid tank 30 (e.g., the cleanest tank 30C (of FIG. 3B) or another liquid tank). Air jets 68 are positioned above cooling surface 74 to blow high pressure air and create a positive pressure downward into the brush chamber area to help negate any fume migration upward. Air jets 68 are supplied with pressurized air by an air supply tube 66 (FIG. 1A).

With reference to FIG. 1A, liquid tanks 30 are filled with liquid through liquid fittings 38 positioned below them. The level of liquid in liquid tanks 30 may be monitored by liquid level sensors 33 in each tank (see FIG. 3A). Each tank 30 may also include overflow features to assist in maintaining a desired level of liquid in the tank. These overflow features may include an overflow tank that collects liquid that overflows the tank and an overflow return 36 that returns the liquid to the tank (or be disposed of). The overflow features are designed to keep the liquid level in each tank relatively constant. Liquid tanks 30 may be coupled to (e.g., mounted on) a fluid tank position-adjustment mechanism 46 that, for example, raises and lowers liquid tanks 30 on vertical guides 42. In other words, the position-adjustment mechanism 46 is configured to move (e.g., vertically) liquid tanks 30 towards and away from brushes 20. In some embodiments, position-adjustment mechanism 46 may include a cam, shaft, and knob arrangement to position the tanks 30 at different elevations to control the amount of liquid distributed to brushes 20. In some embodiments, the elevation of liquid tanks 30 may be locked in place once adjusted. In some embodiments, fluid tank position-adjustment mechanism 46 may include sensors (e.g., fluid level sensors 33A, 33B, 33C of FIG. 3B) and motors (not shown) that automatically (e.g., using a feedback loop) adjust the elevation of liquid tanks 30, for example, based on process parameters (e.g., level of liquid in tanks 30, relative position of brushes 20 in tanks 30, etc.). For example, in some embodiments, as the coating removal process continues, the amount of liquid in liquid tanks 30 decrease. One or more of sensors 33A, 33B, 33C may detect the depleting level of the liquid and control position-adjustment mechanism 46 to raise the tanks 30 to maintain a relatively constant position (e.g., depth) of the brushes 20 in the liquid in liquid tanks 30. In some embodiments, the liquid in liquid tanks 30 may also be supplemented through liquid fittings 38 (see FIG. 1A) based on the sensor readings.

In some embodiments, the different features (e.g., cooling and vacuum assembly, liquid tank assembly, brush assembly, etc.) of apparatus 100 may be formed in a modular manner (e.g., as assemblies) such that these assemblies may be individually removed and replaced. In some embodiments, mechanical fasteners (e.g., clamps, screws, etc.) along with alignment features may be used to align and secure these modular assemblies in apparatus 100. The assemblies may be separated from apparatus 100 and reattached to apparatus using the fasteners.

It should be noted that although the current disclosure is described as being used to remove a coating from an edge (or the edge zone coating) of panel 10, this is only exemplary. For example, apparatus 100 may be used to remove a single or multiple coatings (e.g., multi-layer coatings) from any region (e.g., center, side, etc.) of panel 10. Persons of ordinary skill in the art would recognize that the disclosed apparatus can be used for any application (e.g., to remove paint from the surface of a component, a metallic or polymeric coating from the surface of a ceramic/organic substrate or a semiconductor wafer, etc.). Furthermore, although in the description above, some features were disclosed with reference to specific embodiments, a person skilled in the art would recognize that this is only exemplary, and the features are applicable to all disclosed embodiments. Other embodiments of the apparatus, its features and components, and related methods will be apparent to those skilled in the art from consideration of the disclosure herein.

What is claimed is:

1. An apparatus to remove a coating from a coated panel, comprising:

multiple pairs of rotatable brushes, wherein each pair of the multiple pairs of rotatable brushes is spaced apart from an adjacent pair of rotatable brushes of the multiple pairs of rotatable brushes in a first direction which extends along a first axis, wherein each pair of rotatable brushes of the multiple pairs of rotatable brushes includes two opposing brushes with end faces that face each other, and wherein the two opposing brushes of each pair of rotatable brushes are configured to (a) rotate about a common axis, (b) move towards and away from each other in a second direction transverse to the first direction, and (c) when a coated panel is positioned between the end faces of the two opposing brushes, first portions of the two opposing brushes separably engage with and rotate on opposite surfaces of the coated panel; and one or more liquid tanks each configured to contain a liquid, wherein, when the one or more liquid tanks contain the liquid and when the coated panel is positioned between the end faces of the two opposing brushes, second portions of the two opposing brushes at least contact the liquid in the one or more liquid tanks, wherein each pair of the multiple pairs of rotatable brushes is configured to engage the coated panel extending in the first direction and positioned between each pair of the multiple pairs of rotatable brushes, and wherein each pair of the multiple pairs of rotatable brushes is configured to assist the translation of the coated panel along the first axis, thereby translating between opposing brushes of each of the multiple pairs of brushes.

2. The apparatus of claim 1, wherein a number of the liquid tanks is equal to a number of pairs of rotatable brushes.

3. The apparatus of claim 1, wherein the first portions are top portions of the two opposing brushes and the second portions are bottom portions of the two opposing brushes.

4. The apparatus of claim 1, wherein each brush of the multiple pairs of rotatable brushes includes a polyolefin foam.

5. The apparatus of claim 1, wherein the common axis of rotation of each pair of rotatable brushes extend in the second direction.

6. The apparatus of claim 1, further including a pair of cold plates spaced apart from each other in the second direction to define a gap therebetween, wherein, when the coated panel is positioned between two opposing brushes, the coated panel extends through the gap between the pair of cold plates.

7. The apparatus of claim 6, wherein each cold plate of the pair of cold plates are configured to circulate a coolant therethrough.

8. The apparatus of claim 6, wherein the pair of cold plates are positioned above the multiple pairs of rotatable brushes.

9. The apparatus of claim 1, further including a position-adjustment mechanism configured to move the one or more liquid tanks towards and away from the multiple pairs of rotatable brushes, wherein the position adjustment mechanism comprises one or more of guides, a cam, a shaft, a knob, a fluid level sensor, or a motor.

10. The apparatus of claim 1, further including a plurality of air jets positioned above the multiple pairs of rotatable brushes, wherein the plurality of air jets are configured to direct an air stream towards the one or more liquid tanks.

11. The apparatus of claim 1, wherein, when the end faces of the two opposing brushes rotate on opposite surfaces of the coated panel and the one or more liquid tanks contain the liquid, the two opposing brushes are configured to transfer at least a portion of the coating from the coated panel to the liquid in the one or more liquid tanks.

12. The apparatus of claim 1, wherein all brushes of the multiple pairs of rotatable brushes that are on one side of the coated panel between the multiple pairs of brushes are configured to rotate in a first direction, and all brushes of the multiple pairs of rotatable brushes on the opposite side of the coated panel between the multiple pairs of brushes are configured to rotate in a second direction that is opposite to the first direction.

13. An apparatus to remove a coating from a coated panel, comprising:

multiple pairs of rotatable brushes spaced apart from each other in a first direction which extends along a first axis, wherein each pair of rotatable brushes of the multiple pairs of rotatable brushes includes two opposing brushes with end faces that face each other, and wherein the two opposing brushes of each pair of rotatable brushes of the multiple pairs of rotatable brushes are configured to (a) rotate about a common axis, (b) move towards and away from each other in a second direction transverse to the first direction, and (c) when the coated panel is positioned between the end faces of the two opposing brushes, first portions of the two opposing brushes separably engage with and rotate on opposite surfaces of the coated panel;

one or more liquid tanks each configured to contain a liquid, wherein, when the one or more liquid tanks contain the liquid and when the coated panel is positioned between the end faces of the two opposing brushes, second portions of the two opposing brushes at least contact the liquid in the one or more liquid tanks;

a position-adjustment mechanism configured to move the one or more liquid tanks towards and away from the multiple pairs of rotatable brushes, wherein the position adjustment mechanism comprises one or more of guides, a cam, a shaft, a knob, a fluid level sensor, or a motor; and a plurality of air jets positioned above the multiple pairs of rotatable brushes and configured to direct an air stream towards the one or more liquid tanks, wherein each pair of rotatable brushes is configured to engage the coated panel extending in the first direction between each pair of rotatable brushes of the multiple pairs of rotatable brushes, and wherein each pair of the multiple pairs of rotatable brushes is configured to assist the translation of the coated panel along the first axis, thereby translating between opposing brushes of each of the multiple pairs of brushes.

14. The apparatus of claim 13, wherein each brush of the multiple pairs of rotatable brushes includes a polyolefin foam.

15. The apparatus of claim 13, wherein the common axis of rotation of each pair of rotatable brushes extend in the second direction.

16. The apparatus of claim 13, further including a pair of cold plates spaced apart from each other in the second direction to define a gap therebetween, wherein, when the coated panel is positioned between two opposing brushes, the coated panel extends through the gap between the pair of cold plates.

17. The apparatus of claim 16, wherein each cold plate of the pair of cold plates are configured to circulate a coolant therethrough.

18. The apparatus of claim 17, wherein the pair of cold plates are positioned above the multiple pairs of rotatable brushes.

* * * * *